United States Patent [19]

Brunner et al.

[11] Patent Number: 4,505,809

[45] Date of Patent: Mar. 19, 1985

[54] PROCESS AND APPARATUS FOR EXTRACTING HYDROCARBONS FROM OIL SHALE

[75] Inventors: Gerd Brunner, Roth; Rainer Hoffmann, Nuremberg; Konrad Künstle, Röttenbach, all of Fed. Rep. of Germany

[73] Assignee: Kraftwerk Union Aktiengesellschaft, Mülheim, Fed. Rep. of Germany

[21] Appl. No.: 546,890

[22] Filed: Oct. 31, 1983

[30] Foreign Application Priority Data

Nov. 4, 1982 [DE] Fed. Rep. of Germany ..... 3240745

[51] Int. Cl.[3] ..... C10G 1/02; C10B 53/06; C10B 39/04

[52] U.S. Cl. ..... 208/11 R; 201/38; 201/39; 202/99

[58] Field of Search ..... 208/8 R, 11 R; 201/38, 201/39; 202/94, 95, 99, 227; 122/7 R

[56] References Cited

U.S. PATENT DOCUMENTS

| | | | |
|---|---|---|---|
| 2,434,815 | 1/1948 | Shaw | 208/11 R X |
| 2,725,347 | 11/1955 | Leffer | 202/95 |
| 2,785,115 | 3/1957 | Borch | 202/227 |
| 3,487,001 | 12/1969 | Needham | 208/11 R |
| 3,520,795 | 7/1970 | Schulman et al. | 208/11 R |
| 3,617,472 | 11/1971 | Schlinger et al. | 208/11 R |
| 4,125,996 | 11/1978 | Schmoch | 122/7 R X |
| 4,299,193 | 10/1981 | Dworschak | 122/7 R |
| 4,347,064 | 8/1982 | Reh | 201/38 X |
| 4,437,936 | 3/1984 | Jung | 201/39 |
| 4,454,018 | 6/1984 | Venkatesan et al. | 208/11 R |
| 4,461,673 | 7/1984 | Deering et al. | 201/39 X |

*Primary Examiner*—Delbert E. Gantz
*Assistant Examiner*—Glenn A. Caldarola
*Attorney, Agent, or Firm*—Herbert L. Lerner; Laurene A. Greenberg

[57] ABSTRACT

A process for extracting hydrocarbons from oil shale comprising the steps of subjecting oil shale under super-atmospheric pressure in the presence of hydrogen and steam, to low temperature hydrogenating distillation; separating the resulting fluid distillation mixture into liquid and gaseous products; and returning water and hydrogen separated from the fluid distillation mixture to the low temperature distillation; in which:

heat is drawn-off from the hot oil shale, after treatment in a low temperature hydrogenating distillation reactor, by the shale being sprayed wtih water whereby saturated steam is produced in decreasing pressure stages;

the saturated steam of the pressure stages and water extracted during product separation are fed into the individual stages of a multi-stage compressor driven by a gas turbine, and are then delivered via a steam supply line to the reactor;

the gas turbine is fuelled by supplying separated-off gaseous distillation products thereto; and the exhaust gases of the gas turbine are fed to a heat exchanger arranged in the steam supply line.

7 Claims, 1 Drawing Figure

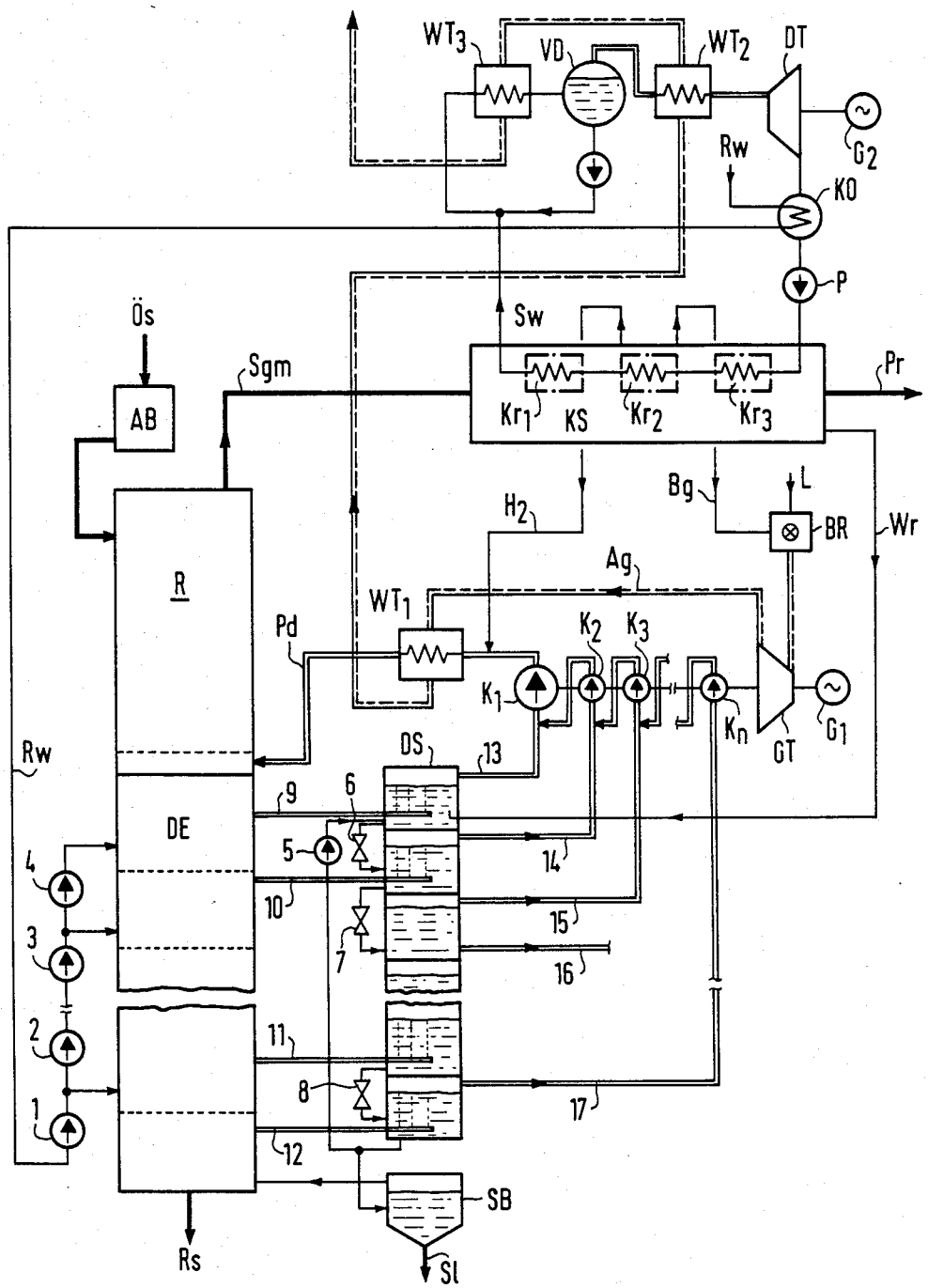
WT3
VD
WT2
DT
G2
Rw
KO
P
Sw
Ös
Sgm
Pr
AB
Kr1
KS
Kr2
Kr3
Bg
L
BR
Wr
H2
Ag
R
WT1
Pd
K2
K3
K1
Kn
GT
G1
Rw
DS
13
9
6
DE
5
14
4
10
15
3
7
16
2
11
8
17
1
12
SB
Rs
Sl

PROCESS AND APPARATUS FOR EXTRACTING HYDROCARBONS FROM OIL SHALE

BACKGROUND OF THE INVENTION

1. Field of the Invention

This invention relates to a process and apparatus for extracting hydrocarbons from oil shale by low temperature hydrogenating distillation.

2. Description of the Prior Art

Considerable crude oil reserves are stored in oil sands and oil shales. The extraction of crude oil from these reserves involves, amongst other things, high costs for the separation of the oil from the sand or shale. Attempts have therefore been made to make the technical processes required for this more favorable with regard to the course of the process, the material used and energy consumption.

A known process for extracting crude oil from oil sand or oil shale discloses subjecting this sand or shale to a low temperature hydrogenating distillation process in a reactor. At increased temperature and under pressure the initial feed material is affected by hydrogen and steam, which hydrogen and steam are at least partially recovered when the fluid distillation mixture is separated into gaseous and liquid products. Considerable amounts of energy are necessary for the entire duration of the process (U.S. Pat. No. 3,617,472).

SUMMARY OF THE INVENTION

An object of the present invention is to provide a process and apparatus for extracting hydrocarbons from oil shale by low temperature hydrogenating distillation, in which the energy used during extraction of the hydrocarbons is at least partly recovered for re-use.

With the foregoing and other objects in view, there is provided in accordance with the invention a process for extracting hydrocarbons from oil shale comprising the steps of subjecting oil shale in the presence of hydrogen and steam to low temperature hydrogenating distillation under superatmospheric pressure; separating the resultant fluid distillation mixture into liquid and gaseous products; and returning water and hydrogen separated from the fluid distillation mixture to the low temperature distillation; in which:

a. heat is drawn-off from the hot oil shale, after the low temperature hydrogenating distillation treatment in a low temperature hydrogenating distillation reactor, by discharging the treated shale from the reactor and passing the shale through zones of decreasing pressure, spraying the shale in the zones with water producing saturated steam in decreasing pressure stages;
b. the saturated steam of the pressure stages commingled with saturated steam from the water separated from the fluid distillation mixture are fed into the individual stages of a multi-stage compressor driven by a gas turbine, and are then delivered through a steam supply line to the reactor;
c. the gas turbine is fuelled by supplying thereto gaseous distillation products separated from the fluid distillation mixture; and
d. the exhaust gases of the gas turbine are fed to a heat exchanger arranged in the steam supply line to heat the steam in the steam supply line to a higher temperature prior to its entrance into the reactor.

In accordance with the invention there is provided apparatus for extracting hydrocarbons from oil shale comprising a reactor for subjecting oil shale in the presence of hydrocarbons and steam to low temperature hydrogenating distillation under pressure, a steam generator arranged to supply steam to the reactor, and a separator arranged to receive a fluid distillation mixture from the reactor, and to separate such mixture into liquid and gaseous products, in which:

a. the steam generator is a multi-stage tower with connecting means to transfer used oil shale from the reactor to the multi-stage tower, and spray means for introduction of water into each stage for spraying used oil shale therein with generation of steam;
b. a multi-stage steam collector with each of its stages connected to a respective one of the stages of the steam generator;
c. a multi-stage compressor with each of its stages connected to a respective one of the stages of the steam collector;
d. a gas turbine arranged to drive the multi-stage compressor;
e. a steam supply line connected between the output of the multi-stage compressor and the reactor; and
f. a heat exchanger arranged in the steam supply line to receive exhaust gases from the gas turbine and to transfer heat therefrom to the steam supplied to the line by the multi-stage compressor.

Other features which are considered as characteristic for the invention are set forth in the appended claims.

Although the invention is illustrated and described herein as embodied in process and apparatus for extracting hydrocarbons from oil shale, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing which diagrammatically illustrates apparatus for extracting hydrocarbons from oil shale by subjecting the oil shale to low temperature hydrogenating distillation under pressure in a reactor, passing the used shale from the reactor into a steam generator in the form of a multi-stage tower with decreasing pressure stages, spraying water on the shale in each of the stages to recover heat from the shale and generate steam, passing the steam from each stage of multi-stage steam generator to a respective stage of a multi-stage steam collector, passing the steam from each stage of the multi-stage steam collector to a multi-stage compressor. The steam from the multi-stage compressor is directed through a steam supply line to the reactor. A gas turbine drives the multi-stage compressor and the exhaust gases from the turbine heat the steam in the steam supply line by means of a heat exchanger.

DETAILED DESCRIPTION OF THE INVENTION

According to the invention hydrocarbons are extracted from oil shale by subjecting the oil shale, at fairly high temperatures and under pressure, and through the effect of hydrogen and steam, to low temperature hydrogenating distillation; the resulting fluid distillation mixture separated into liquid and gaseous products; and separated-off water and hydrogen returned to the low temperature distillation, in which:

heat is drawn-off from the hot oil shale, after treatment in a low temperature hydrogenating distillation reactor, by spraying the shale with water and producing saturated steam in decreasing pressure stages;

the saturated steam of the pressure stages and water extracted during product separation are fed into the individual stages of a multi-stage compressor driven by a gas turbine, and are then delivered via a steam supply line to the reactor;

the gas turbine is fuelled by supplying separated-off-gaseous distillation products thereto; and the exhaust gases of the gas turbine are fed to a heat exchanger arranged in the steam supply line.

In a process according to the invention, the thermal energy contained in the residual (used) shale is recovered as far as possible and this recovered energy is fed into the distillation process in the form of steam. Thus the energy potential of the gaseous distillation products is utilized, with the thermal energy produced by combustion being indirectly used via the exhaust gases of the gas turbine for the final heating of the steam before entering the reactor, and directly for driving the compressor and optionally for generating electricity. The multi-stage design of the heat recovery process provided according to the invention is in the simplest case, in two stages. A one-stage process is also possible but lower thermal efficiency must be accepted.

A further improvement in the energy output may be achieved in a preferred embodiment of the invention by the exhaust gases of the gas turbine being fed to two further heat exchangers which latter are connected in series to a steam turbine. The exhaust steam from the steam turbine is fed to a condenser for heating a natural water supply to the reactor. Then the exhaust steam after passage through the condenser flows through a multi-stage cooler as a coolant and for heating the feed water, the multi-stage cooler being used for separating the gaseous and liquid low temperature distillation from the reactor products. Thereby, the residual heat content of the exhaust gases from the gas turbine and the thermal energy obtained during the product separation is used additionally for driving a steam turbine and is also used for producing the steam for the low temperature process via the condenser connected at the outlet side of the steam turbine.

In designing an apparatus or installation for carrying out the process, particular importance is attached to the construction of the steam generator which is connected in series to the low temperature distillation reactor and which is in operative connection with the separator, connected to the outlet side to the low temperature distillation reactor, for separating the distillation mixture.

According to a further aspect of the invention there is provided apparatus for extracting hydrocarbons from oil shale comprising a reactor for subjecting oil shale to low temperature hydrogenating distillation, an opening in the reactor for the supply of hydrogen and steam to the reactor, a steam generator arranged to supply steam to the reactor, and a separator arranged to receive a fluid distillation mixture discharged from the reactor, and to separate such mixture into liquid and gaseous product, in which:

the steam generator comprises a multi-stage tower to receive used oil shale from the reactor, and to spray the oil shale with water;

a multi-stage steam collector having each of its stages connected to a respective one of the stage of the steam generator;

a multi-stage compressor having each of its stages connected to a respective one of the stages of the steam collector;

a gas turbine to drive the multi-stage compressor;

a steam supply line connecting the output of the multi-stage compressor to the reactor; and a heat exchanger is arranged in said steam supply line to receive exhaust gases from said gas turbine and to transfer heat therefrom to the steam supplied to the line by the multi-stage compressor.

In a preferred embodiment, the individual pressure stages of the steam collector are connected one after the other by pressure-regulating valves in order to extract from the water collecting in one pressure stage, steam in the next lower pressure stage as a result of the water moving from a higher pressure stage to a lower pressure stage and vaporization of some of the water at the lower pressure. It is advisable for a residue tank to be connected on the outlet side of the final pressure stage of the steam chamber. The water in the residue tank can, for example, be used for spraying the used shale in the last pressure stage of the collector.

An embodiment of apparatus according to the invention, and a process according to the invention, will now be described in detail with reference to the accompanying schematic drawing.

The main components of the installation shown are a low temperature hydrogenating distillation reactor R, to which mechanically and, if necessary, physically prepared oil shale Os is supplied from above, a steam generator DE connected to the outlet side at the bottom to the distillation reactor, a steam collector chamber DS connected at the outlet side to the steam generator, a multi-stage compressor, connected on the outlet side to the steam chamber, with compressor stages $K_1 \ldots K_n$ and with a gas turbine GT driving the compressor, and a condensation stage KS, connected at the outlet side to the upper outlet of the reactor R, for separating the fluid distillation mixture Sgm into liquid and gaseous products, and for the separation of water. Included in the condensation stage KS is the feed water cycle of a steam turbine DT.

When operating the installation, fresh oil shale OS reaches the reactor R by means of a preparation device AB and through a preheating—and sluice system that is not further described, the reactor being a fluidized bed reactor. The fluidized bed of the reactor R is kept at a temperature of about 450° C. and a pressure of about 50 bar, by a mixture of steam and hydrogen.

A cyclone with which the gaseous distillation products are separated from the treated shale is arranged in known manner in the upper part of the distillation zone of the reactor R. The treated shale reaches the steam generator DE lying below the reactor R by means of gravity and appropriate discharge elements. This steam generator consists of several towerlike steam generator stages, arranged one on top of the other, which are joined together, one after the other, by appropriate discharge elements for the treated hot shale. In the steam generator the pressure decreases from stage to stage and in the last stage is about 1 bar.

Associated with the individual steam generator stages are pumps 1, 2, 3, 4, with which natural water Rw is sprayed into the respective steam generation stage and hence onto the treated (used) oil shale. Thus saturated steam is produced with pressure decreasing from stage to stage. After the last pressure stage the spent shale Rs falls onto a conveyor belt which conveys the shale to a dumping ground. The moisture on the shale makes discharge easier and prevents the occurrence of smoke on the way to the dumping ground.

The saturated steam produced in the individual stages of the steam generator DE arrives at appropriate pressure stages of a multi-stage towerlike steam collector chamber DS by means of pipes 9, 10, 11, 12. The saturated steam is introduced from the corresponding stage of the steam generator DE inside each pressure stage via a water bath, whereby the rising steam is cleansed of solid particles. The steam collecting in the upper region of each pressure stage is conveyed via pipes 13–17 to multi-stage compressor $K_1 \ldots K_n$.

Water Wr is also supplied to a pressure stage of the steam chamber DS and is recovered in the condensation stage KS from the distilled gas mixture discharged from reactor R. This water is supplied to that pressure stage of the steam chamber DS whose pressure corresponds to the pressure of the corresponding condensation stage.

The individual water tanks of the steam chamber DS are joined together one after the other by means of pressure-regulating valves 6, 7, 8 via which a sludge-containing portion of the water of one pressure stage passes into the chamber of the next lowest pressure stage, in order to introduce heat there and effect partial vaporization of the water as steam. From the lowest pressure stage a sludge-containing part of the water is vigorously pumped and recirculated to steam collector chamber DS by means of the pump 5 to effect increased concentration of the water. The remaining part of the water reaches the residue tank SB. Sludge Sl is drawn off from the bottom of tank SB. Water collecting at the top of tank SB can be used for spraying the shale in the last pressure stage of the steam generator DE.

As already stated, steam that has been collected in the steam chamber DS is supplied to the individual stages $K_1 \ldots K_n$ of a multi-stage compressor, which is driven by the gas turbine GT. The gas turbine also drives a generator $G_1$ to produce electrical current. Combustible gases Bg which are gaseous distillation products extracted in the condensation stage KS are fed to a burner BR of the gas turbine GT. In addition the burner is supplied with air L.

The exhaust gases Ag of the gas turbine are first supplied to a heat exchanger $WT_1$ which is connected, on the outlet side of the multi-stage compressor K, in a steam supply line to the reactor R. Heating by exhaust gases Ag in heat exchanger $WT_1$ brings the process steam Pd produced in the steam generator DE and the steam chamber DS to the temperature necessary for the operation of the fluidized bed in the reactor R. Hydrogen $H_2$ is fed by means of an electrically driven circulation compressor, not further shown, into the steam supply of the reactor R at a point in front of the heat exchanger $WT_1$. This hydrogen also comes from the condensation stage KS.

In the condensation stage KS the cooling of the gaseous distillation mixture and hence the separation of the liquid products Pr takes place with the aid of a cooling water system, into which the steam turbine DT is linked. The cooling water heated in the condensation stage KS is subsequently heated up again in two heat exchangers $WT_3$ and $WT_2$ by the exhaust gas Ag of the gas turbine GT flowing through these heat exchangers after the exhaust gas flows through the heat exchanger $WT_1$ of the compression stage. The cooling water of the condensation stage KS therefore becomes the feed water Sw of the steam turbine DT. The vaporizer VD is connected between the two heat exchangers $WT_3$ and $WT_2$. The exhaust of the steam turbine DT flows into the condenser KO through which, at the same time, flows natural water Rw. The water Rw is heated in the condenser KO and from there is supplied to the steam generator DE. The steam condensate from condenser KO is sent by pump P to the condensation stage KS and through condensation stage product coolers Kr1 . . . Kr3 which are used as a preheating zone for the feed water system of the steam turbine DT.

The gaseous distillation mixture Sgm from reactor R is condensed in stages in the condensation stage KS and is thus prefractionated. A gas rich in hydrogen for the treatment of the oil shale is separated from the gases remaining after condensation, for example, by means of washing. The residual gases are used for firing the gas turbine GT. This firing is separated from the distillation gases of the entire process. By suitable selection of the distillation temperature in the reactor R, the necessary amount of gas may be produced, since with an increasing distillation temperature the amount of gas increases. If electrical current is required, the gas discharge can be increased by raising the distillation temperature and hence the net current capacity of the gas turbine GT can be increased. Electrical current is produced at the same time with the aid of the generator $G_2$ coupled to the steam turbine DT.

With the installation shown, electric current and liquid hydrocarbon can be produced from oil shale in a proportion that can be adjusted within a wide range.

Oil shale and/or oil sands are referred to in the claims as "oil shale".

The foregoing is a description corresponding, in substance, to German application P 32 40 745.9, dated Nov. 4, 1982, international priority of which is being claimed for the instant application, and which is hereby made part of this application. Any material discrepancies between the foregoing specification and the specification of the aforementioned corresponding German application are to be resolved in favor of the latter.

There are claimed:

1. A process for extracting hydrocarbons from oil shale comprising the steps of subjecting oil shale in the presence of hydrogen and steam to low temperature hydrogenating distillation under superatmospheric pressure; separating the resulting fluid distillation mixture into liquid and gaseous products; and returning water and hydrogen separated from the fluid distillation to the low temperature distillation; in which:

(a) heat is drawn-off from the hot oil shale, after the low temperature hydrogenating distillation treatment in a low temperature hydrogenating distillation reactor, by discharging the treated shale from the reactor and passing the shale through zones of decreasing pressure, spraying the shale in the zones with water producing saturated steam in decreasing pressure stages;

(b) the saturated steam of the pressure stages commingled with saturated steam from the water separated from the fluid distillation mixture are fed into the individual stages of a multi-stage compressor driven by a gas turbine and are then delivered through a steam supply line to the reactor;

(c) the gas turbine is fueled by supplying thereto gaseous distillation products separated from the fluid distillation mixture; and (d) the exhaust gases of the gas turbine are fed to a heat exchanger arranged in the steam supply line to heat the steam in the steam supply line to a higher temperature prior to the entrance into the reactor.

2. A process according to claim 1 including the further step of supplying the exhaust gases of the gas turbine after passage through the heat exchanger in the steam supply line to two further heat exchangers which are connected in series to a steam turbine, feeding the exhaust from the steam turbine to a condenser which also serves to heat up the water supply for spraying the hot oil shale, and then conveying the steam turbine exhaust from the condenser to a multi-stage cooler of a separator which receives the resultant fluid distillation mixture output of the reactor and which extracts heat from the steam turbine exhaust and transfers such heat to a feed water supply of the steam turbine.

3. Apparatus for extracting hydrocarbons from oil shale comprising a reactor for subjecting oil shale in the presence of hydrogen and steam to low temperature hydrogenating distillation under pressure, a steam generator arranged to supply steam to the reactor, and a separator arranged to receive a fluid distillation mixture from the reactor, and to separate such mixture into liquid and gaseous products, in which:

(a) the steam generator is a multi-stage tower with connecting means to transfer used oil shale from the reactor to the multi-stage tower, and spray means for introduction of water into each stage for spraying used oil shale therein with generation of steam;

(b) a multi-stage steam collector with each of its stages connected to a respective one of the stages of the steam generator;

(c) a multi-stage compressor with each of its stages connected to a respective one of the stages of the steam collector;

(d) a gas turbine arranged to drive the multi-stage compressor;

(e) a steam supply line connected between the output of the multi-stage compressor and the reactor; and (f) a heat exchanger arranged in said steam supply line to receive exhaust gases from said gas turbine and to transfer heat therefrom to the steam supplied to the line by the multi-stage compressor.

4. Apparatus according to claim 3, wherein the individual stages of the steam collector are connected consecutively by pressure regulating valves.

5. Apparatus according to claim 3, including a residue tank connected to the final pressure stage of the steam collector.

6. Apparatus according to claim 4, including a residue tank connected to the final pressure stage of the steam collector.

7. Apparatus according to claim 3, including an electrical generator arranged to be driven by the gas turbine.

* * * * *